US010646076B2

(12) United States Patent
Shaukat et al.

(10) Patent No.: US 10,646,076 B2
(45) Date of Patent: May 12, 2020

(54) WEARABLE FLUID-DISPENSING APPARATUS

(71) Applicants: Kashif Shaukat, Davie, FL (US); Bernard Lagroue, Miramar, FL (US)

(72) Inventors: Kashif Shaukat, Davie, FL (US); Bernard Lagroue, Miramar, FL (US)

( * ) Notice: Subject to any disclaimer, the term of this patent is extended or adjusted under 35 U.S.C. 154(b) by 0 days.

(21) Appl. No.: 15/886,815

(22) Filed: Feb. 1, 2018

(65) Prior Publication Data

US 2018/0192832 A1 Jul. 12, 2018

Related U.S. Application Data

(63) Continuation of application No. 15/169,916, filed on Jun. 1, 2016, now Pat. No. 9,888,816.
(Continued)

(51) Int. Cl.

| | |
|---|---|
| ***A47K 5/12*** | (2006.01) |
| ***A44C 5/14*** | (2006.01) |
| ***A44C 5/20*** | (2006.01) |
| ***B05B 11/00*** | (2006.01) |
| ***A44C 5/00*** | (2006.01) |

(Continued)

(52) U.S. Cl.
CPC ..... *A47K 5/1201* (2013.01); *A44C 5/0007* (2013.01); *A44C 5/14* (2013.01); *A44C 5/20* (2013.01); *A47K 5/1204* (2013.01); *A47K 5/1211* (2013.01); *B05B 9/085* (2013.01); *B05B 11/0038* (2018.08); *B05B 11/0054* (2013.01); *B05B 11/3014* (2013.01);
(Continued)

(58) Field of Classification Search
CPC ..... A44C 5/0007; A44C 5/14; A44C 5/20; B05B 9/085; B05B 11/3014; B05B 11/0038; B05B 11/0054; B05B 15/62; A47K 5/1201; A47K 5/1202; A47K 5/1205; A47K 5/1207; A47K 5/1204; A47K 5/1211
USPC ..... 222/175, 325–327, 180, 131, 209, 385
See application file for complete search history.

(56) References Cited

U.S. PATENT DOCUMENTS 4,046,495 A * 9/1977 Grimm, Jr. ..... B05B 1/3436 417/268
4,311,255 A * 1/1982 Meshberg ..... B05B 11/0037 222/183

(Continued)

*Primary Examiner* — Paul R Durand
*Assistant Examiner* — Andrew P Bainbridge
(74) *Attorney, Agent, or Firm* — Mark C. Johnson; Johnson | Dalal

(57) ABSTRACT

A wearable fluid-dispensing apparatus that includes a flexible wristband coupled to and surrounding a wrist-arm area of a user, with the wristband having a frame disposed along an outer surface of the wearable wristband and at a ventral side of the user's wrist, an enclosed cartridge coupled to the frame for housing a fluid therein, and a fluid transfer conduit disposed within the enclosed cartridge for transporting the fluid from the enclosed cartridge to a nozzle port on a finger-activatable pump assembly coupled to the frame. The pump assembly defines a nozzle port disposed above a top end of the wristband and angled toward the user's palm, defining a fluid extraction passageway fluidly coupled to the nozzle port and the fluid transfer conduit, and operably configured to translate downwardly toward the fluid extraction passageway fluidly to generate a vacuum therein and emit the fluid on the user's inner hand.

18 Claims, 9 Drawing Sheets

Related U.S. Application Data

(60) Provisional application No. 62/189,887, filed on Jul. 8, 2015.

(51) Int. Cl.
*B05B 9/08* (2006.01)
*B05B 15/62* (2018.01)

(52) U.S. Cl.
CPC ..... *B05B 15/62* (2018.02); *A47K 5/1202* (2013.01); *A47K 5/1205* (2013.01); *A47K 5/1207* (2013.01)

(56) References Cited

U.S. PATENT DOCUMENTS 4,643,338 A * 2/1987 Iizuka ..... B05B 11/3088 222/321.8
4,735,347 A * 4/1988 Schultz ..... B05B 11/3018 222/321.2
5,924,601 A * 7/1999 Chen ..... F41H 9/10 222/175
5,927,548 A * 7/1999 Villaveces ..... A45F 5/02 222/175
6,983,864 B1 * 1/2006 Cagle ..... B05B 11/0005 222/131
7,316,332 B2 * 1/2008 Powers ..... A45D 34/00 222/1
7,988,020 B2 * 8/2011 Shoham ..... A61B 90/80 222/175
8,286,834 B2 * 10/2012 Powers ..... A45D 34/00 222/175
8,757,443 B2 * 6/2014 Pelfrey ..... B65D 51/248 222/113
8,844,766 B2 * 9/2014 Zaima ..... A61L 2/26 222/52
8,973,788 B1 * 3/2015 Burns ..... A47K 5/1201 220/751
9,888,816 B1 * 2/2018 Shaukat ..... A47K 5/1201
10,028,624 B1 * 7/2018 Robinson ..... A47K 5/1202
2003/0150876 A1 * 8/2003 Walters ..... B05B 11/3001 222/153.13
2007/0164050 A1 * 7/2007 Knight ..... A45F 5/02 222/175
2008/0251539 A1 * 10/2008 Yapaola ..... A44C 5/003 222/175
2010/0025432 A9 * 2/2010 Yapaola ..... B05B 11/3015 222/175
2010/0122993 A1 * 5/2010 Tenbrink ..... A61L 2/22 222/175
2011/0155765 A1 * 6/2011 Properzi ..... A47K 5/1201 222/175
2013/0037572 A1 * 2/2013 Yapaola ..... B05B 11/3015 222/175
2015/0216367 A1 * 8/2015 Barbier ..... A47K 5/1201 222/1
2018/0078011 A1 * 3/2018 Parker ..... A44C 9/0069

* cited by examiner

WEARABLE FLUID-DISPENSING APPARATUS

CROSS-REFERENCE TO RELATED APPLICATION

This application is a continuation application of pending U.S. patent application Ser. No. 15/169,916, filed Jun. 1, 2016, which claims priority to U.S. Provisional Patent Application No. 62/189,887, filed Jul. 8, 2015, the entirety of both are incorporated by reference.

FIELD OF THE INVENTION

The present invention relates to application of a fluid, such as an antibacterial composition, to an individual's hands and, more particularly, is concerned with a wearable fluid-dispensing apparatus for dispensing, among other things, an antibacterial fluid composition.

BACKGROUND OF THE INVENTION

Concerns about personal hygiene have become increasingly prevalent in modern society. With seemingly ever-increasing frequency we hear of spreading viruses, threats of epidemics, and a general heightened awareness of the multitude of gems that we come in contact with every day. For most people, good hygiene is so much an integral part of their daily routine that they think little about it. Among other hygienic practices, tier example, individuals wash their hands before and after preparing and/or eating food, and after handling an object or coming into contact with a potentially unsanitary surface. Various products are available to help sanitize an individual's hands, such as wipes infused with a liquid antibacterial solution, antibacterial soaps, and the like.

Consequently, the population as a whole has become ever more conscious of the danger posed by pathogens such as *E. coli*, Ebola, the growing threat of the bird flu virus and other viruses, as well as the more common pathogens an individual comes into contact with on a daily basis. The constant exposure to a wide Variety of bacteria and viruses, particularly through contact with unsanitary surfaces, has the potential to cause an one of a number of undesirable infections. The acquisition and transfer of bacteria via a person's hands is recognized as a major factor in the spread of disease. Thus, antibacterial products for hand washing are formulated to reduce the number of bacteria on a person's hands more effectively than plain soap. In response to this threat, many businesses offer their patrons access to antibacterial products. For instance supermarkets commonly offer antibacterial wipes for consumers to handle of a shopping cart, as well as antibacterial dispensers in areas dedicated for bottle returns and the like.

However, not every business encountered by consumers offer access to complementary antibacterial products. Further, individuals frequently experience unsanitary situations throughout the day where it is impractical to immediately wash one's hands with soap and water, or to carry a commercially available container of antibacterial solution or a dispenser of antibacterial wipes. Therefore, as an insight by the inventor herein, it would be highly desirable to provide a fashionable wearable device having a means for storing, and quickly and efficiently dispensing, a quantity of antibacterial solution onto the hands of a wearer of the device. Furthermore, as another insight by the inventor herein, it would be desirable to provide such an apparatus wherein a volume of such a solution or composition could be provided within a disposable cartridge adapted to be releasably engaged with a dispensing mechanism integrated into the device Therefore, a need exists to overcome the problems with the prior art as discussed above.

SUMMARY OF THE INVENTION

The invention provides a wearable fluid-dispensing apparatus that overcomes the hereinafore-mentioned disadvantages of the heretofore-known devices and methods of this general type and that is operably configured to effectively and efficiently sanitize a user's hands.

With the foregoing and other objects in view, there is provided, in accordance with the invention, a wearable fluid-dispensing apparatus that includes a flexible wristband coupled to and surrounding a wrist-arm area of a user, a frame disposed along an outer surface of the wearable wristband and at a ventral side of the user's wrist, wherein the frame has a bottom wall, an upper wall, and a pair of lateral walls defining a receptacle. The wristband also includes an enclosed cartridge coupled to and retained within the receptacle by the frame for housing a fluid therein and has an extraction port disposed on an upper end of the enclosed cartridge. The wristband also includes a fluid transfer conduit disposed within the enclosed cartridge and has a lower end disposed proximal to an inner surface of a lower end of the enclosed cartridge to intake fluid within the enclosed cartridge and an upper end disposed proximal to the extraction port of the enclosed cartridge. The wristband also includes a finger-activatable pump assembly coupled to the frame and includes a piston that defines a nozzle port disposed above a top end of the wristband and angled toward the user's palm. The piston also defines a fluid extraction passageway fluidly coupled to the nozzle port and the fluid transfer conduit and is operably configured to translate downwardly toward the fluid extraction passageway fluidly to generate a vacuum therein for emitting the fluid to a user's palm or inner hand.

In accordance with a further feature of the present invention, the piston is operably configured to translate upwardly away from the fluid extraction passageway to emit the fluid housed in the enclosed cartridge from the nozzle port in a fluid emission path at an emission angle directed toward the user's palm. The emission angle may also be approximately 45° with respect to the upward direction of translation of the piston.

In accordance with an additional feature of the present invention, the nozzle port is disposed at or proximal to the palm of the user.

In accordance with another feature, an embodiment of the present invention includes the piston having a top portion defining a terminal upper end of the piston and a lever coupled thereto and extending downwardly from the terminal upper end of the piston to interpose, with the frame, a portion of the enclosed cartridge. The lever may include an outer surface of an arcuate shape and terminates at a distal end of the lever, wherein the outer surface may include one or more protrusions disposed thereon and proximal to the distal end for tactile feedback to the user.

In accordance with yet another feature, an embodiment of the present invention includes the enclosed cartridge having two opposing sidewalls, a rear wall, and a bottom wall, wherein the receptacle is shaped and sized to conform to a shape of the enclosed cartridge defined by a portion of the rear wall and the two opposing sidewalls of the enclosed cartridge. In one embodiment, the enclosed cartridge is selectively removably coupled to frame for refilling.

In accordance with an additional feature, an embodiment of the present invention includes the finger-activatable pump assembly having a housing defining a lower port, wherein the housing coupled to the enclosed cartridge in a watertight configuration with the lower port of the housing fluidly coupled to the extraction port of the enclosed cartridge.

In accordance with a further feature, an embodiment of the present invention also includes a plurality of fixed risers interposing the piston and having a terminal end disposed above a top portion defining a terminal upper end of the piston.

In accordance with present invention, a wearable fluid-dispensing apparatus is also disclosed that includes a flexible wristband defining an aperture for receiving a user's forearm, a frame disposed along an outer surface of the wearable wristband and having a bottom wall, an upper wall, and a pair of lateral walls defining a receptacle, an enclosed cartridge coupled to and retained within the receptacle by the frame for housing a fluid therein and having an extraction port disposed on an upper end of the enclosed cartridge, and a fluid transfer conduit disposed within the enclosed cartridge and having a lower end disposed proximal to an inner surface of a lower end of the enclosed cartridge and an upper end disposed proximal to the extraction port of the enclosed cartridge. The apparatus/wristband also includes a finger-activatable pump assembly coupled to the frame and includes a piston defining a nozzle port for emission of the fluid housed within the enclosed cartridge, defining a fluid extraction passageway fluidly coupled to the nozzle port and the fluid transfer conduit, having a static position along piston translation path with the nozzle port disposed above a top end of the wristband, wherein the piston translation path spans downward in a direction toward and upward in a direction away from the fluid extraction passageway. The piston also includes a depressed position along the piston translation path to generate a vacuum within the fluid extraction passageway and the fluid transfer conduit and emit a fluid at an emission angle of approximately 45° with respect to the piston translation path.

In accordance with a further feature, an additional embodiment of the present invention also includes a plurality of fixed risers interposing the piston and having a terminal end disposed above a top portion defining as terminal upper end of the piston when the piston is in the static position along the piston translation path.

In accordance with the present invention, a method of sanitizing a user's hands with a wearable fluid-dispensing apparatus, wherein the method includes the steps of providing a flexible wristband with a frame disposed along an outer surface thereof, wherein the frame has a bottom wall, an upper wall, and a pair of lateral walls defining a receptacle that houses an enclosed cartridge retained by the frame, wherein the enclosed cartridge housing a sanitizing fluid and having an extraction port disposed on an upper end of the enclosed cartridge. The apparatus includes a fluid transfer conduit disposed within the enclosed cartridge and has a lower end disposed within the sanitizing fluid and an upper end disposed proximal to the extraction port of the enclosed cartridge and includes a finger-activatable pump assembly coupled to the frame and including a piston defining a nozzle port disposed above a top end of the wristband and defining a fluid extraction passageway fluidly coupled to the nozzle port and the fluid transfer conduit, wherein the piston is operably configured to translate downwardly in a direction toward the fluid extraction passageway fluidly. The method also includes encircling a user's forearm with a flexible wristband to dispose the frame, enclosed cartridge, and the piston at a ventral side of the user's wrist and with the nozzle port of the piston angled toward a user's palm. The method also includes depressing the piston of the finger-activatable pump assembly, generating a vacuum within the fluid extraction passageway and the fluid transfer conduit to emit the fluid housed in the enclosed cartridge through the nozzle port at an act to emission angle with respect to the downwardly direction toward the fluid extraction passageway.

Although the invention is illustrated and described herein as embodied in a wearable fluid-dispensing apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplar of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used hereto, is defined as two or more than two. The term "another," as used herein, is defined as at least a second or more. The terms "including" and/or "having," as used herein, are defined as comprising open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figures. In this document, the term "longitudinal" should be understood to mean in a direction corresponding to a direction of the depressing of the piston of the pump assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
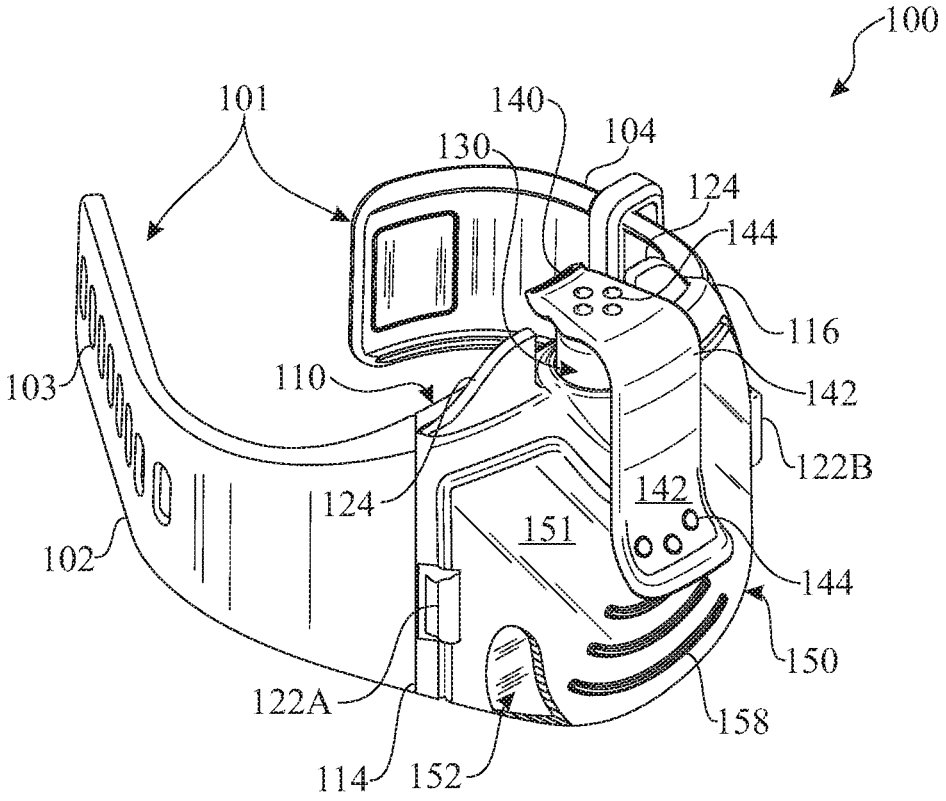
FIG. 1 is an upper front isometric view of an exemplary embodiment of a wearable dispensing apparatus in the form of an antibacterial fluid-dispensing bracelet in accordance with aspects of the present invention.
Figure 2:
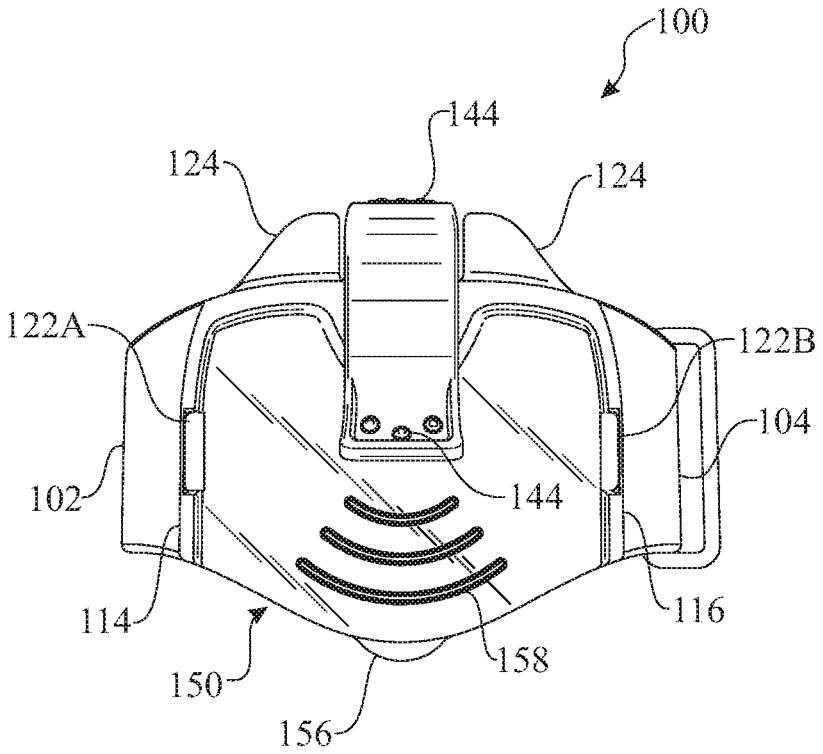
FIG. 2 is a front elevation view of the antibacterial fluid-dispensing bracelet originally introduced in FIG. 1.
Figure 3:
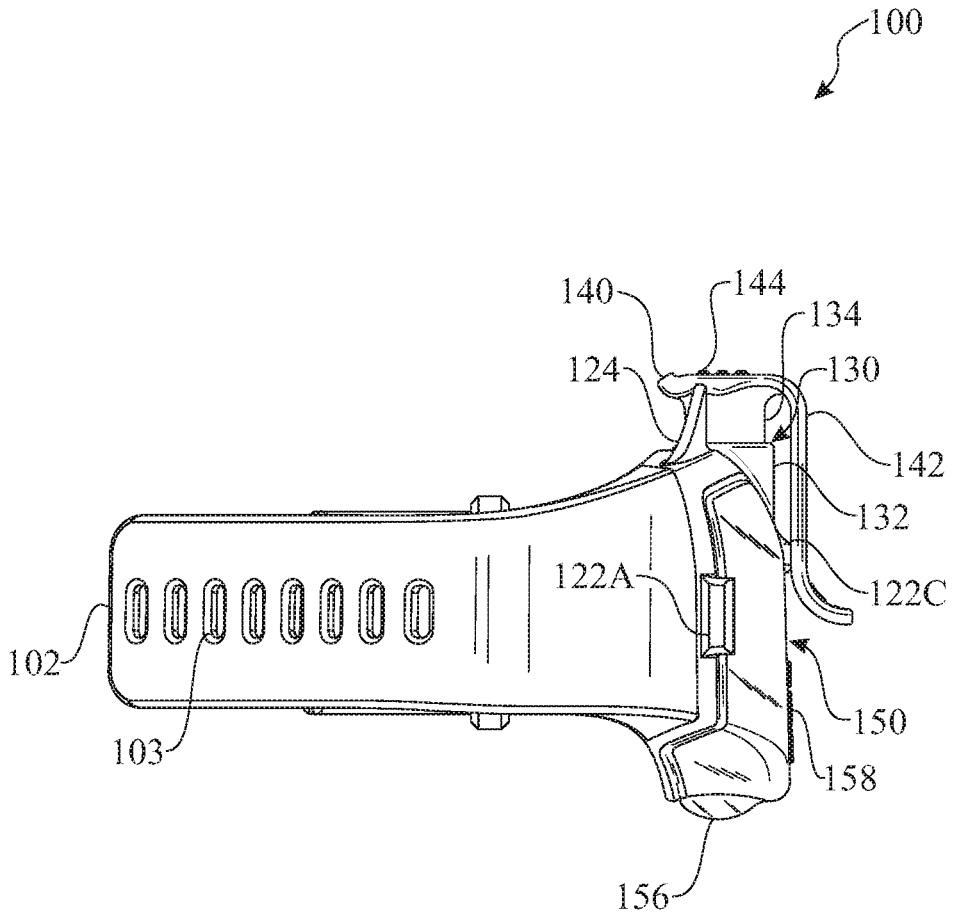
FIG. 3 is a side elevation view of the antibacterial fluid-dispensing bracelet originally introduced in FIG. 1 and as seen from left of the bracelet in FIG. 2.
Figure 4:
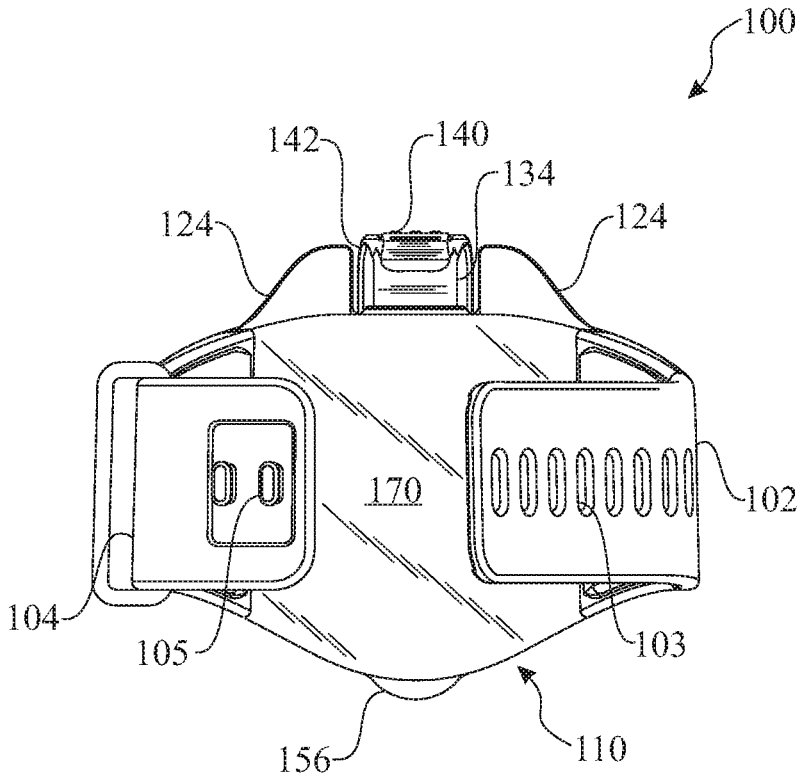
FIG. 4 is a rear elevation view of the antibacterial fluid-dispensing bracelet originally introduced in FIG. 1.
Figure 5:
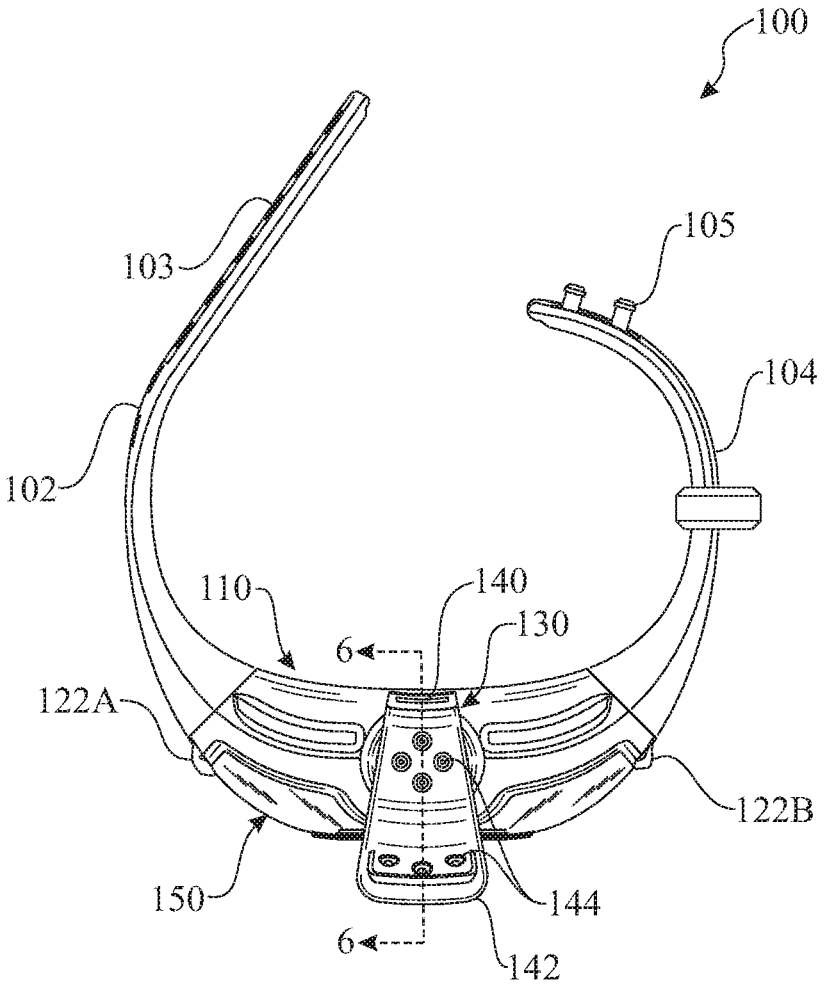
FIG. 5 is a top plan view of the antibacterial fluid-dispensing bracelet originally introduced in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient wearable fluid sanitizing dispenser. Any implementation described herein as "exemplary" or "illustrative" is not necessarily to be construed as preferred or advantageous over other implementations. All of the implementations described below are exemplary is provided to enable persons skilled in the art to make or use the embodiments of the disclosure and are not intended to limit the scope of the disclosure which is defined by the claims. For purposes of description herein, the terms "upper", "lower", "left," "rear," "right," "front," "vertical," "horizontal," and derivatives thereof relate to the invention as oriented in FIG. 1. Furthermore, there is no intention to be bound by any expressed or implied theory presented in the preceding, technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to accompanying FIGS. 1-9, an exemplary implementation embodying aspects of the present invention is depicted. Specifically, a wearable fluid dispensing apparatus, generally designated as 100, in the form of a fluid-dispensing bracelet, preferably wearable about the wrist/forearm of an individual. The bracelet 100 generally includes a frame 110, and a finger-activatable pinup assembly 130 supported, and an arcuate-shaped receptacle 120 (FIGS. 7 and 8) defined, by the frame 110. The frame 110 has a slightly curved bottom wall 115 and a pair opposite first and second lateral side walls, 114 and 116 flared outwardly in opposite directions from a pair of opposite side edges of the bottom wall 115, respectively, defining the central receptacle 120, which is sized, shaped and otherwise has a geometry to conform with and receive a cartridge 150 containing a fluid, such as of an antibacterial fluid. While the wearable fluid-dispensing bracelet 100 can be used with a cartridge 150 containing any fluid, it is best suited for use with fluids, such as an antibacterial fluid, sunscreen, etc., to be used on the body of the wearer.

The frame 110 also may have a pair of integral clasps, 122A and 122B, extending from the corresponding respective lateral side walls, 114 and 116 for releasable engagement with the antibacterial fluid-containing cartridge 150 to aid in retaining the cartridge within the central receptacle 120 of frame 110. Preferably, the clasps 122A, 122B are integrally molded with lateral side walls 114, 116 of the frame 110 to form a unitary structure, wherein the clasps are resilient vis-à-vis the frame 110 to enable deflection of the clasps for snap-fitting engagement with cartridge 150, in a manner well known in the art. Those practiced in the art will readily recognize that the clasps can also assume other configurations known in the art.

The wearable fluid-dispensing apparatus or bracelet 100 also includes a wearable member 101 formed by a female wristband segment 102 and a male wristband segment 104. The female wristband segment 102 is affixed to the frame 110 proximate the first lateral side wall 114. The female wristband segment 102 has a series of spaced apart apertures 103 along a length thereof to aid in fastening the bracelet 100 to a user's wrist or forearm. In like manner, the male wristband segment 104 is affixed to the frame 110 proximate the second lateral side wall 116. The male wristband segment 104 may include one or more pegs 105, or comparable projections, extending therefrom for releasable engagement with selected ones of the apertures 103 of the female wristband 102 to releasably secure the bracelet 100 to a user's wrist or forearm, in a manner well known in the art. Those practiced in the art will recognize that other known configurations of the wearable member 101 attached to the frame 110 are contemplated herein.

Figure 6A:
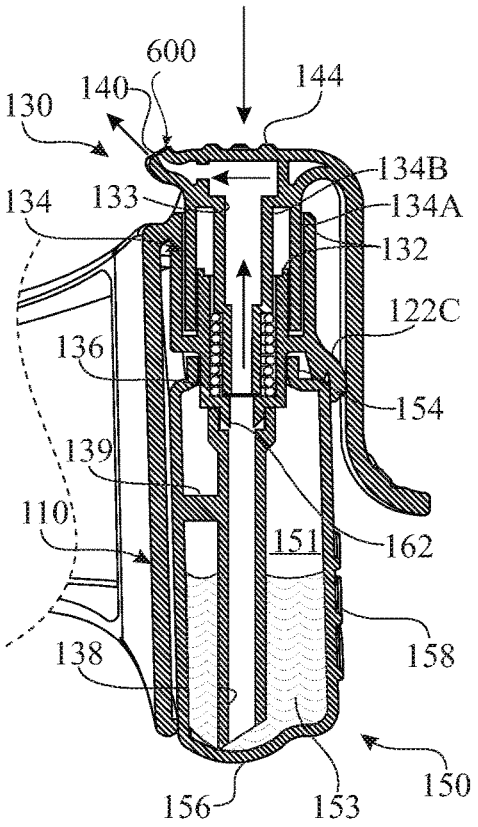
FIG. 6A is a cross-sectional view of the antibacterial fluid-dispensing bracelet originally introduced in FIG. 5, and as taken along section line 6-6 of FIG. 5, wherein a finger-activated pump assembly of the fluid-dispensing bracelet is shown in a downwardly-biased (pressure applied) dispensing state.
Figure 6B:
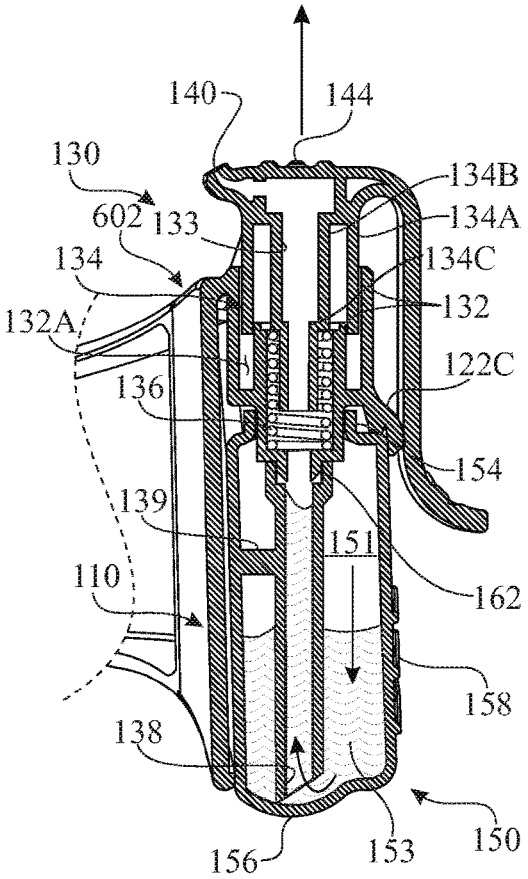
FIG. 6B is a cross-sectional view of the antibacterial fluid-dispensing bracelet originally introduced in FIG. 5, and as taken along section line 6-6 of FIG. 5, wherein the pump assembly of the fluid-dispensing bracelet is shown in an equilibrium (unbiased) state.
Figure 7:
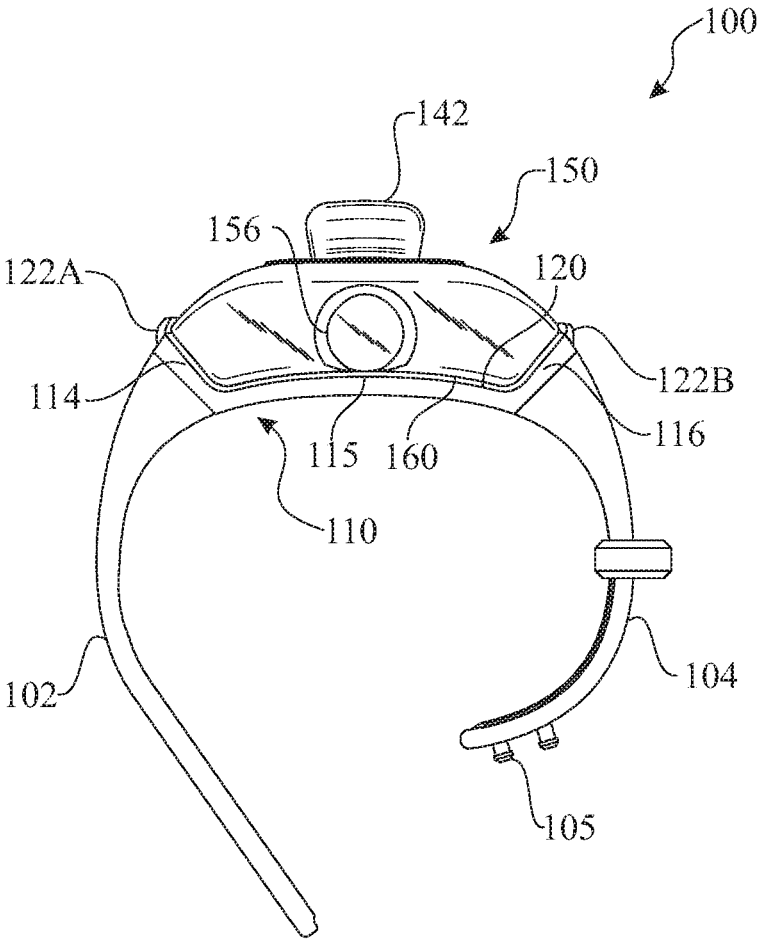
FIG. 7 is a bottom plan view of the antibacterial fluid-dispensing bracelet originally introduced in FIG. 1.
Figure 8:
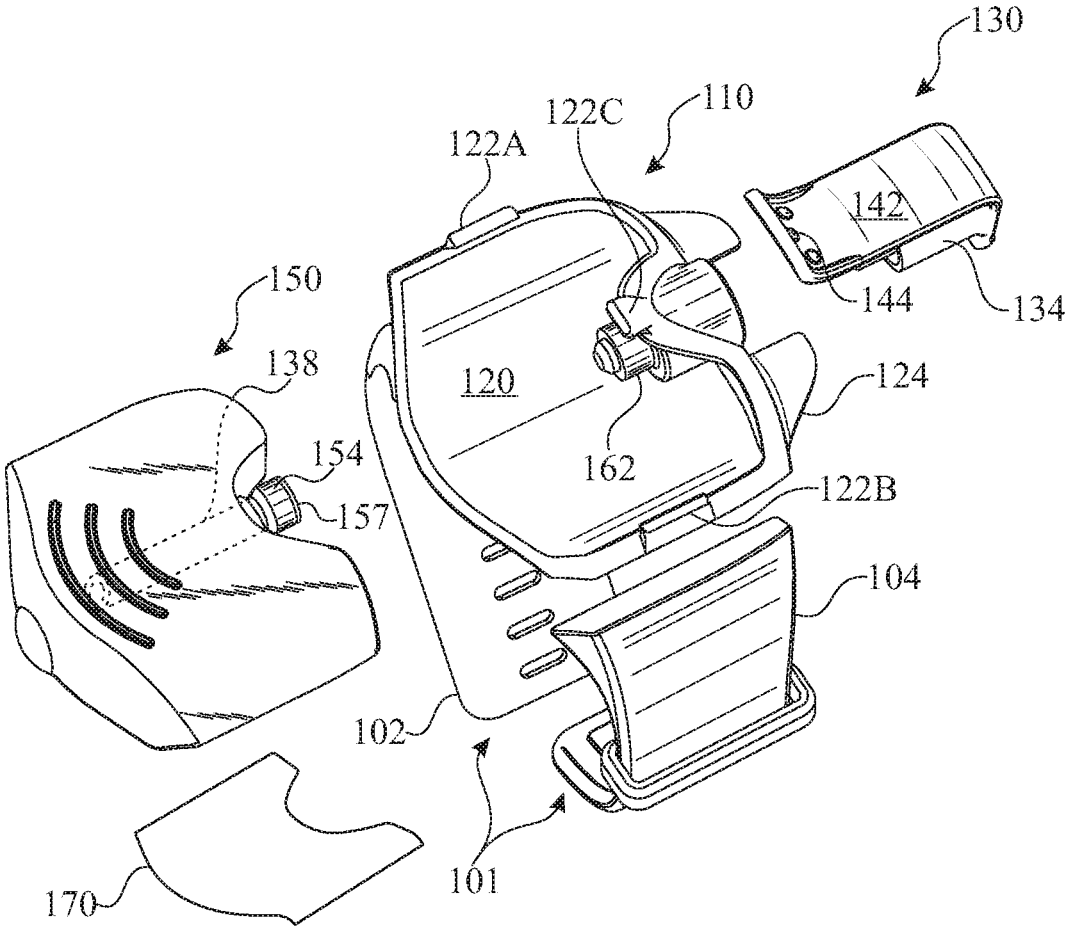
FIG. 8 an exploded isometric view of the antibacterial fluid dispensing bracelet originally introduced in FIG. 1.

Referring now particularly to FIGS. 1, 6A and 6B, fluid-containing cartridge 150 has a body defining an interior reservoir 152 for retaining a volume of antibacterial fluid 153 and is retained within frame 110 by lateral clasps 122A, 122B and a central clasp 122C on an upper wall of frame 110 proximate to the central receptacle 120 and at one end of the bottom wall 115 and opposite first and second lateral sidewalk 114, 116 thereof. A grip area 158 can be included on the front exterior surface 151 of the cartridge 150 to aid in the removal and insertion of the cartridge 150. As best seen in FIG. 8, the cartridge 150 also defines an annular-shaped extraction port 154 at a top center thereof for engagement with an annular housing portion 132 of the finger-activatable pump assembly 130, as described below. A bulge 156 (see also FIGS. 2-4) is formed at a central bottom portion of the cartridge 150 to provide a low point for pooling of the antibacterial fluid when the fluid level is at a minimum, in order to minimize waste of the antibacterial fluid. A rear exterior surface 160 (FIG. 7) of cartridge 150 can also include a label 170 applied thereto wherein the label 170 includes descriptive and usage information related to the fluid retained therein. In this case, it is preferable that the cartridge is constructed of a translucent (clear) material. This also facilitates viewing through the cartridge to determine the relative quantity of fluid remaining. Although not depicted, it will be apparent to those skilled in the art that the cartridge 150 may be constructed having hash marks for determining the remaining volume of fluid 153.

As best illustrated in FIGS. 1, 3, 6A and 6B, the finger-activatable pump assembly 130 at the annular housing 132 thereof is affixed to, or at regions thereof is integrally formed with, the upper wall of the frame 110. The pump assembly 130 thus includes the annular-shaped housing 132, preferably having a double-walled structure, which are two concentrically arranged and aligned sidewalls (as shown in FIGS. 6A and 6B). The pump assembly 130 also includes a piston 134 vertically slidable within and supported by the annular housing 132. The piston 134 includes a pair of spaced apart exterior and interior walled portions 134A and 134B and a bottom walled portion 134C attached to, and offset inwardly and extending downwardly from, the interior walled portion 134B. The exterior walled portion 134A of the piston 134 is slidably retained in an annular slot 132A formed within and defined by the double-walled structure of the annular housing 132. The interior walled portion 134B of the piston seats on a top end of, and the bottom walled piston portion 134C of the piston 134 extends downward through, a centrally-located biasing spring 136 supported in the annular slot (shown best in FIGS. 6A and 6B) of the annular housing 132. The interior and bottom walled portions 134B and 134C of the piston 134 define a centrally-located extraction passageway 133 through the piston 134 and into fluid communication with a fluid transfer conduit 138 (or "dip tube") of the cartridge 150, as described further hereinbelow.

The piston 134 of the pump assembly 130 is translatable between a raised position (FIG. 6B) and a depressed position (FIG. 6A). The piston 134 defines at an upper portion thereof, protruding beyond the annular housing 132, a nozzle port 140 from which a quantity of fluid, pumped upwardly from the cartridge 150, through the fluid transfer conduit 138 and the extraction passageway 133, is dispensed during activation of the pump assembly 130. An upper end of the biasing spring 136, such as a compression spring, engages the interior walled portion 134B of the piston 134 to bias the piston 134 in the raised position (FIG. 6B). The fluid transfer conduit 138 is fixedly attached to the sidewall of the cartridge 150 via an attachment structure 139 such that the conduit 138 is fixedly retained in a generally vertically disposed orientation with a lower end extending into cartridge bulge 156 and an upper end fitted about a lower portion of the annular housing 132 defining a lower port 162 of the pump assembly 130. The annular housing 132 of the pump assembly 130, above the lower port 162 thereof, snugly fits through the extraction port 154, i.e., the cartridge mouth or cartridge port, of the cartridge 150 such that the piston 134 communicates via the extraction passageway 133 through the interior and bottom walled portions 134B and 134C thereof with the interior reservoir 152 of the cartridge 150. A lower end of the biasing spring 136 is seated on an annular shoulder in the extraction port 154. The fluid transfer conduit 138, the annular housing 132, and the piston 134 define a fluid pathway extending, centrally through the biasing spring 136, between the interior reservoir 152 (FIG. 1) of the antibacterial fluid-containing cartridge 150 and the fluid extraction passageway 133 "pump chamber") just shy of the nozzle port 140, wherein the pump chamber can be seen extending from the nozzle port 140, i.e., outlet valve, to the lower port 162, i.e., inlet valve.

The annular housing 132 of the pump assembly 130 closely fits or engages with the extraction port 154 of the antibacterial fluid-containing cartridge 150 when the cartridge 150 is fully engaged with the frame 110 and retained in place by the clasps 122A, 122B and 122C, and provides a leak-proof seal at the extraction port 154. The fluid transfer conduit 138 at its upper end is spaced below the extraction port 154 of the cartridge 150 and extends downward through the interior reservoir 152 of the cartridge 150 substantially to the bottom of the cartridge bulge 156 for maximum extraction of the antibacterial fluid therein. The upper wall of the frame 110 can also include fixed risers 124 or "guards," which are disposed on either side of the upper portion of the piston 134 proximate to the nozzle port 140 thereof to protect the piston 134 of the pump assembly 130 from inadvertent activation or from catching on clothing or other articles.

The piston 134 of the finger-activatable pump assembly 130 can also include a grip surface 144 at a top portion thereof so that the user can get a tactile indication of when the user's finger is properly positioned to activate the pump assembly 130. Additionally, a lever 142 can be affixed to the piston 134 for activation thereof and also includes a grip surface 144, or one or more protrusions 144, at an end thereof for further tactile feedback to the user. As illustrated in FIGS. 6A and 6B, the piston 134 and the lever 142 are integrally molded as a single unit; however other configurations of the piston 134, the nozzle port 140, and the lever 142 are contemplated.

Referring briefly primarily to FIGS. 6A and 6B, during use a user initially activates, by depressing, the piston 134 of the pump assembly 130 as depicted by the downward arrows in FIG. 6A, and then de-activates, by releasing, the piston of the pump assembly, creating a vacuum, or negative pressure, that draws a volume of fluid 153 up through conduit 138 into fluid extraction passageway 133. Subsequently, upon once again activating, by depressing, the piston 134 of the pump assembly 130, pressure forces a volume of the fluid 153 out through nozzle port 140 into the user's hand for subsequent application to the hands and/or other body parts as desired. FIG. 6 depicts the piston 134 in a static position along a piston translation path, or axis of the piston translation path, with the nozzle port 140 disposed above a top end 602 of the wristband. The piston translation path, which can be seen best in FIGS. 6A and 6B, spans in a downward direction toward the fluid extraction passageway 133 and upward in a direction away from the fluid extraction passageway 133.

Figure 9:
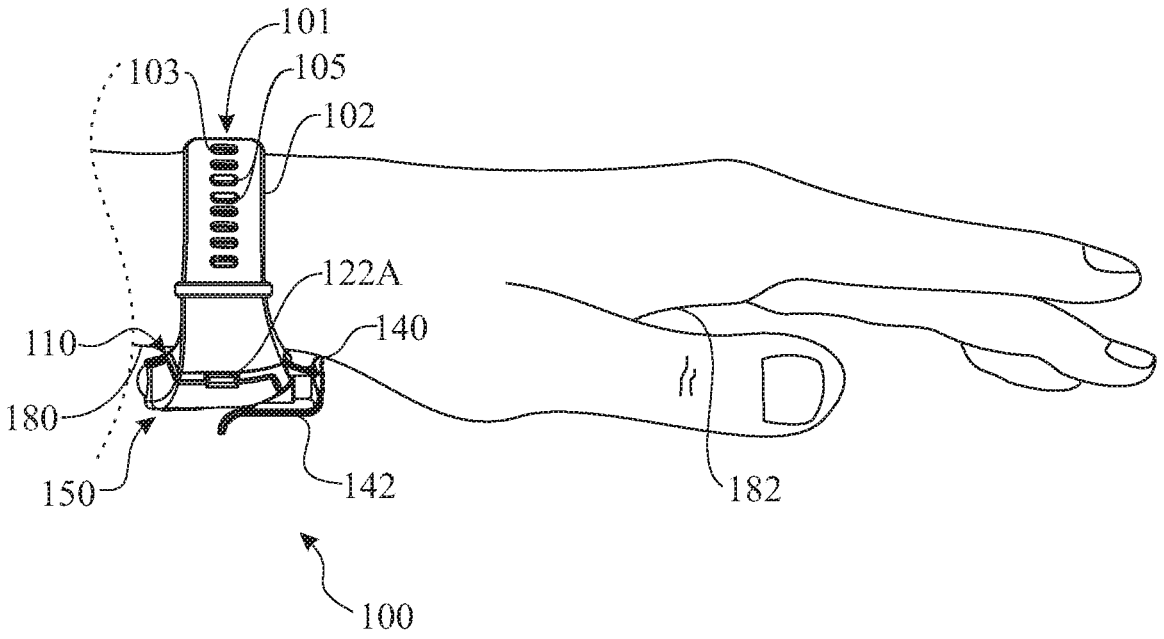
FIG. 9 is a side elevation view of the antibacterial fluid-dispensing bracelet originally introduced in FIG. 1 being shown worn on the wrist of a user.

In use, and as illustrated in FIG. 9, the antibacterial (or other composition of solution) final dispensing bracelet 100 can be worn by a user by placing the frame 110 against an inner portion of the user's wrist 180 and orienting the nozzle port 140 toward the user's inner hand 182. Specifically, also with reference to FIGS. 6A and 6B, the nozzle port 140 may be defined on a substantially planar (referred to herein as "planar") surface 600, wherein the surface 600 and port 140 are configured and oriented to face the palm 182 of a user's hand when the bracelet 100 is worn by the user, i.e., surrounding the wrist-arm area of the user. Said another way, when the bracelet 100 is worn by the user, the frame 110 is disposed on the ventral side of the user's wrist with the nozzle port 140 and fluid emission path (shown best with the arrow depicted in FIG. 6B) from the nozzle port 140 disposed above a top end 602 of the wristband and angled and oriented (hereinafter "emission angle"), approximately 45° (with respect to the down and direction or axis of movement of the depression of the piston 134 of the pump assembly 130 and/or the general directional flow of fluid through the fluid transfer conduit 138 as depicted by the upward arrow depicted in FIG. 6B). The wristband 100 can be seen positioned on and surrounding a forearm of the user and defining an aperture or channel sized to receive the user's forearm or limb, with the frame 110, finger-activated pump assembly 130, and enclosed cartridge 150 disposed on the ventral side of the user's forearm/wrist area with the nozzle port angled toward the palm or inner hand 182 of the user.

The wristband strap, formed by the female and male wristband segments 102 and 104, is maneuvered to encircle the user's forearm/wrist 180 (as shown in FIG. 9), wherein one or more pegs 105 of male wristband segment 104 are engaged in apertures 103 of female wristband segment 102 to secure the antibacterial fluid-dispensing bracelet 100 in place upon the user's wrist 180. With the bracelet 100 securely in place, the user may go about daily activities. When the situation arises that the user wishes to dispense a quantity of antibacterial fluid, the user places a finger on the grip 144 of either the piston 134 or the lever 142 and then activates, by depressing, the piston 134. This will force a quantity of the antibacterial fluid trough the nozzle port 140 in the direction of the inner hand 182 and/or palm of the user. The nozzle port 140 can be seen in FIG. 9 disposed adjacent to the user's hand proximal to the wrist of the user when the liquid is emitted from the nozzle port 140. As seen in FIG. 9, with reference with FIGS. 6A and 6B, the depressing of the piston 134 of the finger-activatable pump assembly 130, or a "depressed position" along the piston translation path (exemplarily shown with arrows in FIGS. 6A and 6B), generates a vacuum within the fluid extraction passageway 133 and the fluid transfer conduit 138 to emit the fluid housed in the enclosed cartridge 150 through the nozzle port 140 at an acute emission angle (visually depicted with arrows in FIG. 6B) with respect to the downwardly direction toward the fluid extraction passageway 133.

When the quantity of antibacterial fluid has been depleted from the interior reservoir 152 of the antibacterial fluid-containing cartridge 150, the user unfastens the clasps 122 from engagement with the cartridge 150 and placing a thumb or finger on the grip portion 158 of the cartridge 150 slides the cartridge 150 downward to disengage front the pump subassembly 130 and frame 110. A new cartridge 150 may then be installed by positioning and sliding the extraction port 154 of the cartridge 150 over the lower port 162 of the housing portion 132 of the pump assembly 130 to tear through a cartridge-opening sealing membrane 157 (FIG. 8) to thereby initiate fluid communication between the cartridge interior 152 and the linger pump fluid extraction, passageway 133, is the conduit 138. Additional quantities of antibacterial, or other composition, fluid can then be extracted by activation of the piston 134 of the pump assembly 130 as previously described.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents. By way of example, although the exemplary implementation of the present invention has been described particularly for in conjunction with antibacterial fluid-dispensing cartridges, it is contemplated that the invention will be employed for use with cartridges containing other fluids including, for example, sunscreen, insect repellent and any other compositions available in a fluid form useful for being carried by a person for convenient dispensing and rubbing onto the skin, hair, etc., of the individual's body (or another individual's body).

What is claimed is:

1. A wearable fluid-dispensing apparatus comprising:

a flexible wristband configured to define a circular opening and couple to and surround a wrist-arm area of a user disposed within the circular opening;

a frame disposed along an outer surface of the wearable wristband and configured for placement at a ventral side of the user's wrist, the frame having a bottom wall, an upper wall, and a pair of lateral walls defining a receptacle;

an enclosed cartridge coupled to and retained within the receptacle by the frame for housing a fluid therein and having an extraction port disposed on an upper end of the enclosed cartridge;

a fluid transfer conduit disposed within the enclosed cartridge and having a lower end disposed proximal to an inner surface of a lower end of the enclosed cartridge and an upper end disposed proximal to the extraction port of the enclosed cartridge; and a finger-activatable pump assembly coupled to the frame and including a piston:

defining a nozzle port disposed above a top end of the wristband and angled in an orientation facing away from the top end of the wristband and toward the circular opening defined by the flexible wristband when the piston is in a static position along an axis of a piston translation path spanning towards and away from the bottom wall of the frame;

defining a fluid extraction passageway fluidly coupled to the nozzle port and the fluid transfer conduit; and operably configured to translate downwardly on the axis of the piston translation path to pressurize the fluid housed in the enclosed cartridge through the nozzle port in a fluid emission path at an emission angle directed away from the top end of the wristband.

2. The wearable fluid-dispensing apparatus according to claim 1, wherein:

the emission angle is approximately 45° with respect to the axis of the piston translation path.

3. The wearable fluid-dispensing apparatus according to claim 2, wherein:

the nozzle port is disposed at or proximal to the palm of the user.

4. The wearable fluid-dispensing apparatus according to claim 3, wherein the piston further comprises:

a top portion defining a terminal upper end of the piston; and a lever coupled thereto and extending downwardly from the terminal upper end of the piston to interpose, with the frame, a portion of the enclosed cartridge, the lever including an outer surface of an arcuate shape and terminating at a distal end of the lever.

5. The wearable fluid-dispensing apparatus according to claim 4, wherein the outer surface of the lever further comprises:

at least one protrusion disposed thereon for tactile feedback to the user.

6. The wearable fluid-dispensing apparatus according to claim 1, wherein the enclosed cartridge further comprises:

two opposing sidewalls, a rear wall, and a bottom wall, wherein the receptacle is shaped and sized to conform to a shape of the enclosed cartridge defined by a portion of the rear wall and the two opposing sidewalls of the enclosed cartridge.

7. The wearable fluid-dispensing apparatus according to claim 1, wherein:

the enclosed cartridge is selectively removably coupled to the frame.

8. The wearable fluid-dispensing apparatus according to claim 1, wherein the finger-activatable pump assembly further comprises:

a housing defining a lower port, the housing coupled to the enclosed cartridge in a watertight configuration with the lower port of the housing fluidly coupled to the extraction port of the enclosed cartridge.

9. The wearable fluid-dispensing apparatus according to claim 1, further comprising:

a plurality of fixed risers interposing the piston and having a terminal end disposed above a top portion defining a terminal upper end of the piston.

10. A wearable fluid-dispensing apparatus comprising:

a flexible wristband defining an aperture for receiving a user's forearm;

a frame disposed along an outer surface of the wearable wristband and having a bottom wall, an upper wall, and a pair of lateral walls defining a receptacle;

an enclosed cartridge coupled to and retained within the receptacle by the frame for housing a fluid therein and having an extraction port disposed on an upper end of the enclosed cartridge;

defining a nozzle port for emission of the fluid housed within the enclosed cartridge; and a finger-activatable pump assembly coupled to the frame and operably configured to have:

a static position along a translation path with the nozzle port disposed above a top end of the wristband and angled in an orientation facing away from the top end of the wristband and towards the aperture for receiving a user's forearm defined by the flexible wristband, the piston translation path defining an axis of movement and spanning in a downward direction towards the bottom wall of the frame and the enclosed cartridge and upward in a direction away from the bottom wall of the frame and the enclosed cartridge; and a depressed position along the piston translation path to emit a fluid at an emission angle of approximately 45° with respect to the axis of movement of the piston translation path.

11. The wearable fluid-dispensing apparatus according to claim 10, further comprising:

a fluid transfer conduit disposed within the enclosed cartridge and having a lower end disposed proximal to an inner surface of a lower end of the enclosed cartridge and an upper end disposed proximal to the extraction port of the enclosed cartridge; and a piston having:

defining the nozzle port for emission of the fluid housed within the enclosed cartridge;

defining a fluid extraction passageway fluidly coupled to the nozzle port and the fluid transfer conduit, wherein the static position along an axis of a piston translation path has the nozzle port disposed above a top end of the wristband, the piston translation path spanning in a downward direction toward the fluid extraction passageway and upward in a direction away from the fluid extraction passageway, and the depressed position along the piston translation path including the piston operably configured to pressurize the fluid housed in the frame to emit a fluid at an emission angle of approximately 45° with respect to the piston translation path;

a top portion defining a terminal upper end of the piston; and a lever coupled thereto and extending downwardly from the terminal upper end of the piston to interpose, with the frame, a portion of the enclosed cartridge, the lever including an outer surface of an arcuate shape and terminating at a distal end of the lever.

12. The wearable fluid-dispensing apparatus according to claim 11, wherein the outer surface of the lever further comprises:

at least one protrusion disposed thereon for tactile feedback to the user.

13. The wearable fluid-dispensing apparatus according to claim 11, wherein the finger-activatable pump assembly further comprises:

a housing defining a lower port, the housing coupled to the enclosed cartridge in a watertight configuration with the lower port of the housing fluidly coupled to the extraction port of the enclosed cartridge.

14. The wearable fluid-dispensing apparatus according to claim 11, further comprising:

a plurality of fixed risers interposing the piston and having a terminal end disposed above a top portion defining a terminal upper end of the piston when the piston is in the static position along the piston translation path.

15. The wearable fluid-dispensing apparatus according to claim 10, wherein the enclosed cartridge further comprises:

two opposing sidewalls, a rear wall, and a bottom wall, wherein the receptacle is shaped and sized to conform to a shape of the enclosed cartridge defined by a portion of the rear wall and the two opposing sidewalls of the enclosed cartridge.

16. The wearable fluid-dispensing apparatus according to claim 10, wherein:

the enclosed cartridge is selectively removably coupled to frame.

17. A method of sanitizing a user's hands with a wearable fluid-dispensing apparatus, comprising the steps of providing a flexible wristband with:

defining an aperture for receiving a user's forearm;

a frame disposed along an outer surface thereof, the frame having a bottom wall, an upper wall, and a pair of lateral walls defining a receptacle that houses an enclosed cartridge retained by the frame, the enclosed cartridge housing a sanitizing fluid and having an extraction port disposed on an upper end of the enclosed cartridge;

a fluid transfer conduit disposed within the enclosed cartridge and having a lower end disposed within the sanitizing fluid and an upper end disposed proximal to the extraction port of the enclosed cartridge; and a finger-activatable pump assembly coupled to the frame and including a piston defining a nozzle port disposed above a top end of the wristband and defining a fluid extraction passageway fluidly coupled to the nozzle port and the fluid transfer conduit, the piston operably configured to translate downward in a direction on an axis of a piston translation path towards and away from the bottom wall of the frame;

encircling a user's forearm with a flexible wristband to dispose the frame, enclosed cartridge, and the piston at a ventral side of the user's wrist and with the nozzle port of the piston angled in an orientation facing away from the top end of the wristband and towards the aperture for receiving a user's forearm defined by the flexible wristband; and depressing the piston of the finger-activatable pump assembly in a downward direction towards the bottom wall of the frame to pressurize the fluid in the enclosed cartridge to emit the fluid housed in the enclosed cartridge through the nozzle port at an acute emission angle with respect to the downward direction towards the bottom wall of the frame.

18. The method according to claim 17, wherein:

the emission angle is approximately 45°.

* * * * *